US005623884A

United States Patent [19]

Penterson et al.

[11] Patent Number: 5,623,884

[45] Date of Patent: Apr. 29, 1997

[54] TILTING COAL NOZZLE BURNER APPARATUS

[75] Inventors: Craig A. Penterson, Sutton; Donald S. Langille, deceased, late of Worcester, both of Mass., by Frances E. Langille, executrix

[73] Assignee: DB Riley, Inc., Worcester, Mass.

[21] Appl. No.: 567,204

[22] Filed: Dec. 5, 1995

[51] Int. Cl.[6] ..... F23D 1/02

[52] U.S. Cl. ..... 110/264; 110/234; 239/406

[58] Field of Search ..... 110/101 CF, 104 B, 110/261, 262, 263, 313, 347; 239/399, 403, 405, 406, 587.1, 587.5, 587.6; 431/183

[56] References Cited

U.S. PATENT DOCUMENTS

| | | | |
|---|---|---|---|
| 2,895,435 | 7/1959 | Bogot et al. | 239/587.4 |
| 4,252,069 | 2/1981 | McCartney | 110/104 B |
| 4,274,343 | 6/1981 | Kokkinos | 110/263 |
| 4,304,196 | 12/1981 | Chadshay et al. | 122/449 |
| 4,434,747 | 3/1984 | Chadshay | 122/449 |
| 4,517,904 | 5/1985 | Penterson et al. | 110/264 |
| 4,651,653 | 3/1987 | Anderson et al. | 110/234 |
| 5,040,470 | 8/1991 | Lofton et al. | 110/234 |
| 5,392,720 | 2/1995 | Briggs et al. | 110/264 |
| 5,417,564 | 5/1995 | Briggs | 431/179 |
| 5,435,492 | 7/1995 | Tenerowicz | 239/587.6 |

*Primary Examiner*—Henry A. Bennett
*Assistant Examiner*—Pamela A. O'Connor
*Attorney, Agent, or Firm*—Mason, Kolehmainen, Rathburn & Wyss

[57] ABSTRACT

Apparatus for burning fuel comprises a conduit having an outlet end for supplying a fuel/air mixture to a fuel burning zone. A nozzle structure is provided adjacent the outlet end of the conduit mounted for pivotal movement about a pivot axis extending transversely across the conduit. The nozzle structure has an inlet end portion surrounding the outlet end of the conduit and has a plurality of separate outlet sections joining the inlet end portion. Swirl vanes are mounted in each of the outlet sections for causing the fuel/air mixture in adjacent outlet sections to swirl about respective central swirl axes of the outlet sections in opposite directions.

21 Claims, 2 Drawing Sheets

TILTING COAL NOZZLE BURNER APPARATUS

BACKGROUND OF THE INVENTION

1. Field of the Invention

The present invention relates to a new improved tilting coal nozzle burner apparatus for furnaces and boilers. More particularly, the present invention is directed to a burner for pulverized coal and other fuels having a nozzle structure at the outlet end of a primary coal/air conduit which is tiltable up and down relative to the central axis of the conduit and which has a plurality of outlet sections having swirl vanes therein which cause the primary coal/air streams exiting from adjacent nozzle sections to swirl in opposite directions. By adjusting the angle of tilt of individual burner nozzles on the walls of a furnace, an operator is better able to adjust the heat distribution and fuel burning process to obtain improved stem temperature control and boiler efficiency while reducing the formation of $NO_X$ and other gaseous emissions.

2. Background of the Prior Art

The new and improved burner and nozzle structure of the present invention is especially well adapted for use in turbulent furnaces such as that shown and described in U.S. Pat. No. 4,517,904, incorporated herein by reference and sold by the assignee herein under the trademark "TURBO."

U.S. Pat. No. 2,895,435 discloses a tilting nozzle for a fuel burner with a single nozzle structure and U.S. Pat. Nos. 4,252,069 and 4,274,343 disclose fuel burner structures having plural tilting nozzles for a single primary air and coal stream. Similarly, U.S. Pat. Nos. 4,304,196 and 4,434,747 disclose burner arrangements having plural tiltable nozzles for each primary air and coal stream in a vertically stacked array of the streams.

U.S. Pat. No. 5,392,720 discloses a flame retaining tiltable nozzle tip having vanes for causing swirling action of a primary air and coal stream.

U.S. Pat. No. 5,417,564 discloses a method for altering the firing pattern in a furnace utilizing non-tilting nozzles in vertically stacked combinations for directing the discharging coal and primary air streams to swirl in opposite directions.

OBJECTS OF THE INVENTION

It is an object of the present invention to provide a new and improved fuel burning apparatus having a tiltable nozzle structure for discharging plural streams of coal and primary air to swirl in opposite directions received from a single source or common flow conduit.

Still another object of the present invention is to provide a new and improved furnace having one or more fuel burners with tiltable nozzle tip structures employing swirl vanes in adjacent outlet sections for directing separate streams of primary air and fuel to swirl in opposite directions.

Yet another object of the present invention is to provide a new and improved fuel burner for receiving a main stream of primary air and fuel and directing the stream into a combustion zone divided into plural streams swirling in opposite directions and tiltable relative to the main stream.

It is yet another object of the present invention to provide a new and improved tiltable coal nozzle especially adapted for retrofitting as well as new applications to provide directional flame control.

Another object of the present invention is to provide a new and improved tiltable coal nozzle which provides better control for reduced $NO_X$ emissions, increased carbon burnout, more positive steam temperature control and better flame stability.

Still another object of the present invention is to provide a new and improved tiltable coal nozzle structure for lowering the primary combustion zone away from overfire air ports to provide more retention time for lowering $NO_X$ emissions.

Yet another object of the present invention is to provide a new and improved tiltable coal nozzle structure for raising and lowering the main fireball in a furnace for better control of final steam temperature and final exhaust gas temperature and maximizing carbon burnout.

BRIEF SUMMARY OF THE PRESENT INVENTION

The foregoing and other objects and advantages of the present invention are accomplished in a new and improved apparatus comprising a furnace having a combustion chamber with at least one wall and one or more fuel burners mounted on the wall in burner openings therein. Each burner includes a conduit for receiving a flow of primary air and fuel supplied to the burner and includes a windbox for supplying secondary combustion air to the combustion chamber through the burner openings around the burners.

Each burner includes a central fuel/air duct having an outlet end centered in the burner opening and a nozzle structure is provided in the burner opening mounted for movement about a pivot axis extending transversely across the wall opening. The nozzle structure includes a plurality of outlet sections, each having swirl vanes for causing a part of the main primary air and fuel stream to swirl around a central axis of the outlet section. The part streams in adjacent outlet sections are directed by the swirl vanes to swirl in opposite directions, flowing into said combustion chamber.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT OF THE INVENTION

Figure 1:
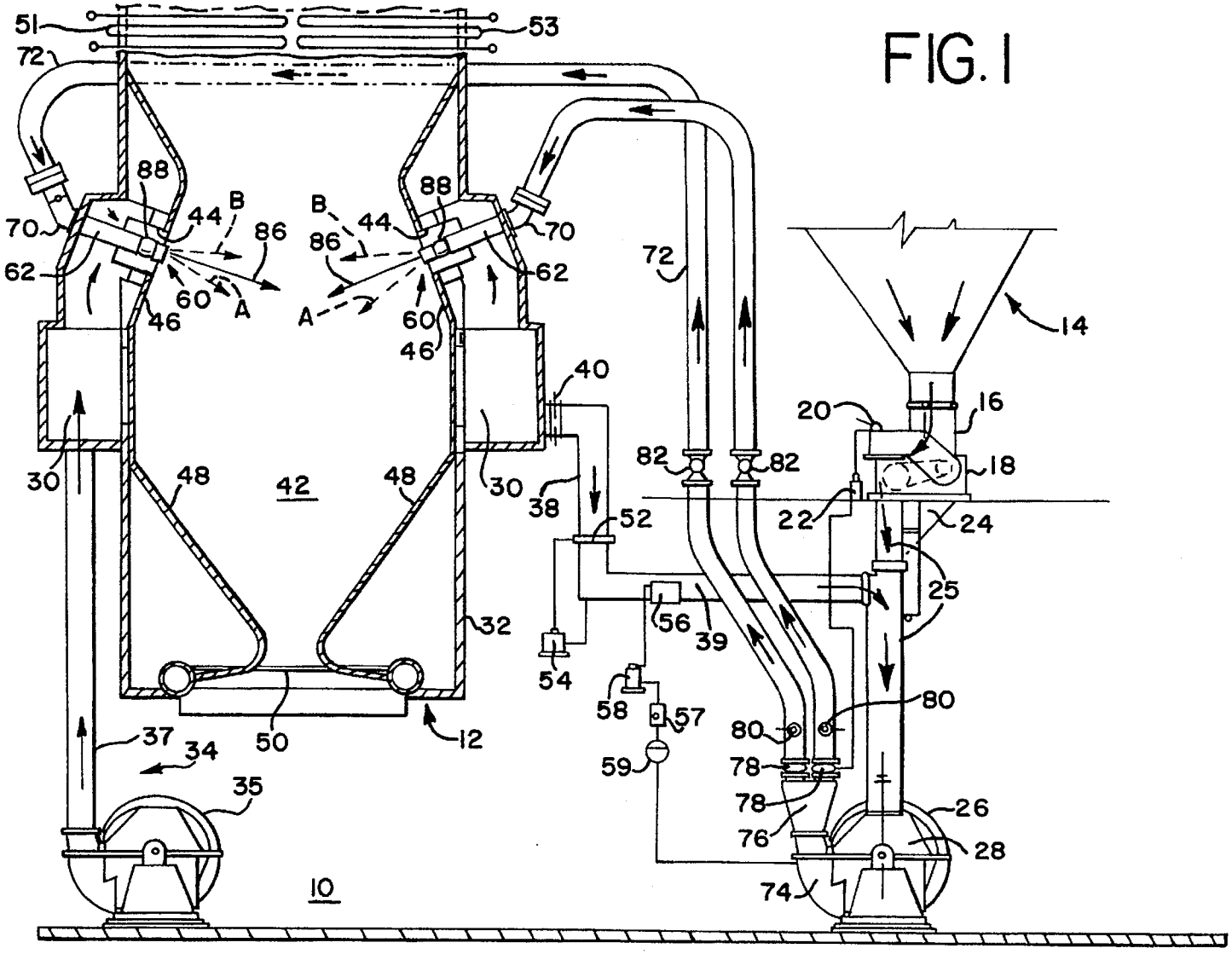
FIG. 1 is a sectional and elevational view of a furnace and fuel supply system in accordance with the features of the present invention.

Referring now more particularly to the drawings, in FIG. 1 is illustrated a new and improved furnace and fuel supply system constructed in accordance with the features of the present invention and referred to generally by the reference number 10.

The furnace and fuel supply system 10 includes an upstanding furnace 12 for burning pulverized coal or other fossil fuels, which fuels may be supplied from a storage system including a hopper 14 in a case when coal is used as fuel, or in tanks, pipelines, etc. (not shown) in cases when other fossil fuels are used.

Coal from the hopper 14 flows down through an outlet in communication with an inlet or feed chute 16 of a drum type coal feeder 18. The feeder 18 is driven by a variable speed drive unit 20 to provide an appropriate fuel feeding rate as controlled by an automatic fuel feed control 22 which is set to respond to the furnace demand for fuel.

Coal from the drum type feeder 18 flows down an outlet chute 24 through a vertical coal feed chute 25 to the inlet side of a coal pulverizer 28 in which the lumps of coal are broken down to a fine powder or dust for burning in the furnace 12. Primary combustion air for the furnace 12 is supplied through a windbox 30 on side walls 32 of the furnace 12. A fan or blower 26 directs primary air and coal into the pulverizer 28. Secondary air supplied from the windbox 30 enters the interior of the furnace 12 through openings 44 in side wall sections 46 of the furnace opening immediately surrounding coal nozzles 60 which supply fuel for the furnace.

A secondary air supply duct system 34 provides secondary air to the windbox 30 and includes a fan or blower 35 having an outlet connected to a duct 37 feeding the windbox. Primary combustion air is taken from the windbox 30 through a shut-off damper valve 40 and is directed into the coal feed chute via branch ducts 38 and 39. Below the level of the windbox 30, the furnace 12 includes inwardly and downwardly sloping wall sections 48 adjacent a lower end 50 of a turbulent combustion chamber 42. The wall sections 46 and 48 of the combustion chamber 42 comprise water/steam tubes for receiving heat from the combustion process to generate steam. Additional steam/water tube banks 51, 53, etc. are provided downstream of the combustion chamber 42 for generation and superheating of steam.

The primary air flow in the duct 38 from the windbox 30 is modulated by a suction control damper 52 which is driven and controlled by a suction controller 54 having a sensor downstream of the damper. The air flow in the duct 39 is modulated by an air temperature damper 56 driven and controlled by a air temperature controller 58 having a sensor on the discharge or outlet side of the coal pulverizer 28. An alarm 57 of a visual or audible type and a temperature indicator 59 are associated with the air temperature controller 58 and a sensor circuit connected to the outlet side of the coal pulverizer 28.

In accordance with the present invention, the furnace 12 is provided with one or more, new and improved, burners 60 constructed in accordance with the features of the present invention. Each burner 60 is centrally disposed in a burner opening 44 in the combustion chamber wall section 46 and includes a main duct or conduit section 62 having a flanged inlet 64 at an outer end secured to an outside wall 66 of the windbox 30 around a rectangular opening 68 provided therein in coaxial alignment with an associated burner opening 44 in the combustion chamber wall section 46. The inlet flange 64 of the burner 60 is connected to a flanged elbow 70, which in turn is connected to a coal/air pipe 72 for supplying a controlled flow of primary combustion air and pulverized coal to the burner.

Each coal pipe 72 is supplied with primary combustion air which carries the pulverized coal from an outlet duct or section 74 of the coal mill or pulverizer 28. The outlet duct 74 is connected to a transition section 76 having plural outlets, each of which is connected to an air/coal control damper 78 for modulating the flow of primary combustion air and pulverized coal carried thereby to the-burner 60 via a coal pipe 72. The air/coal control dampers 78 are controlled and interconnected with the automatic fuel feed controller 22 which controls the drum type coal feeder 18 as previously described.

Downstream of the air/coal dampers 78 each coal pipe 72 is provided with a variable orifice control plate 80, preferably of a type constructed in accordance with the teaching of copending U.S. patent application Ser. No. 08/559,169, filed Nov. 13, 1995. The orifice control plates 80 are adjustable to vary the cross-sectional flow area therethrough to more precisely control the amount of primary air and pulverized coal supplied to each burner 60 of the furnace 12. Downstream of the variable orifice control plates 80, each coal pipe 72 is provided with a shut-off valve 82 for cutting off the supply of primary combustion air and pulverized coal to the furnace 12.

Figure 3:
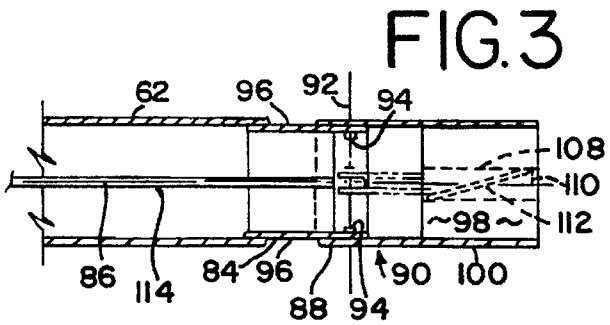
FIG. 3 is a fragmentary horizontal cross-sectional view taken substantially along lines 3—3 of FIG. 2.
Figure 4:
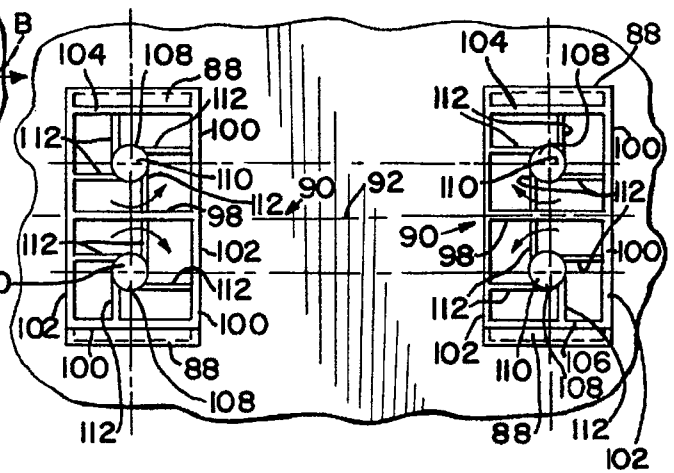
FIG. 4 is a fragmentary, cross-sectional view taken substantially along lines 4—4 of FIG. 2.
Figure 2:
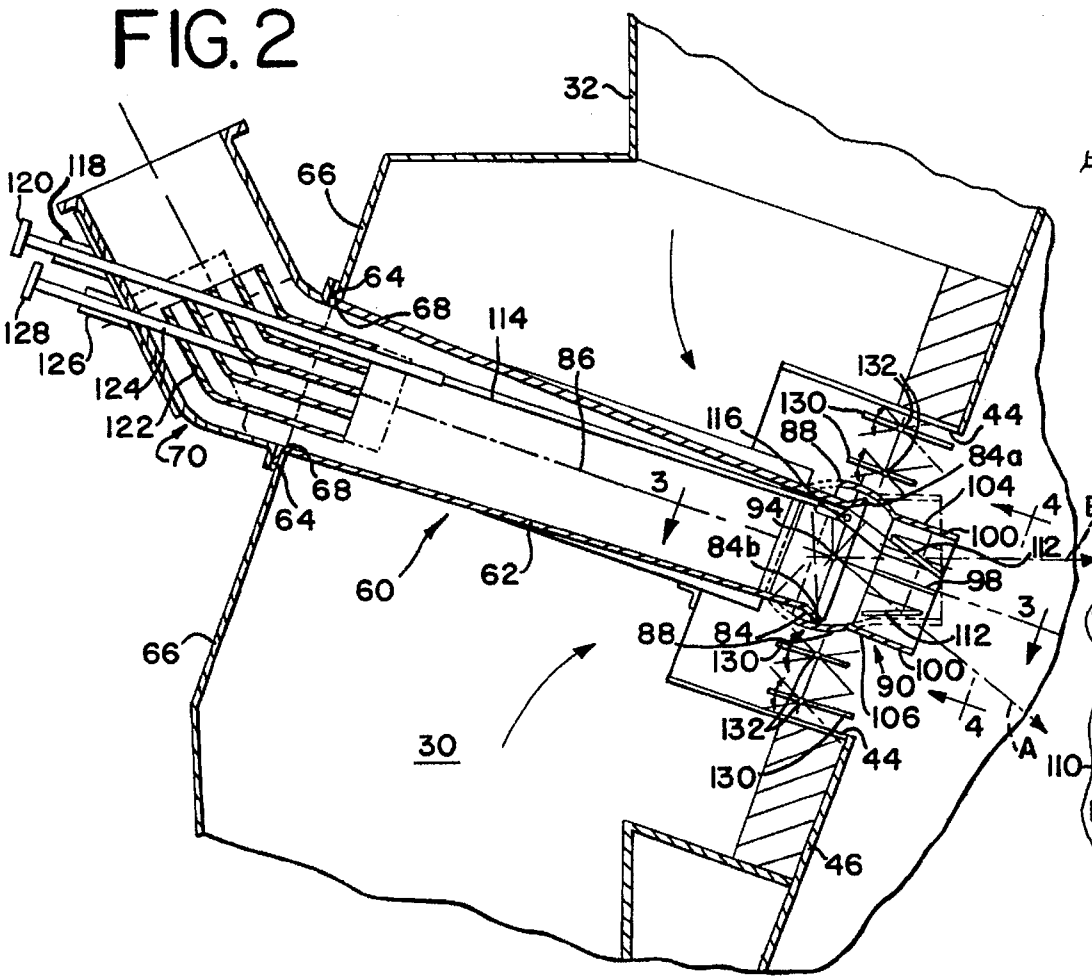
FIG. 2 is an enlarged, fragmentary, sectional elevational view of a burner and surrounding structure of the furnace.

Referring now to FIGS. 2, 3 and 4, the main duct or conduit 62 of each burner 60 is generally frustoconical in shape and tapers at a shallow angle inwardly along its length from the inlet flange 64 toward an outlet end section 84 disposed in the center of combustion chamber wall opening 44 along a common central longitudinal axis 86. The outlet end section 84 transitions from a circular, cross-sectional shape to a rectangular or square shape and is relatively short in length, tapering upwardly and downwardly to a maximum vertical dimension at an outlet end. The tapered upper and lower ends 84*a* and 84*b* (FIG. 2) closely approach or contact the inside surface of a frustocylindrical shaped inlet end portion 88 of a tilting, nozzle outlet structure 90 constructed in accordance with the features of the present invention.

The nozzle outlet structure or burner tip 90 is mounted for tilting pivotal movement about a transverse or lateral axis 92 (FIGS. 3 and 4) extending horizontally across the burner opening 44 and coaxially aligned with mounting pins 96 on opposite side walls 98 of the inlet end portion 88. The longitudinal and lateral axes 86 and 92 intersect at a right angle near the outlet end of the outlet section 84 as best shown in FIG. 2.

Each nozzle outlet structure 90 includes a plurality of outlet sections 100 in a vertically stacked array separated by a common divider wall 98. As viewed in FIG. 4, each outlet section 100 has a substantially rectangular or square-shaped transverse cross-section with common, outer, parallel vertical side walls 102 and upper and lower walls 104 and 106 are provided at right angles to the side walls in parallel with the central divider wall 98 forming the top and bottom of a vertically stacked array of a pair of outlet sections. At the center of each outlet section 100, there is provided a cylindrical element 108 having a longitudinal axis parallel with the divider wall 98. Each cylindrical element 108 has a circular outer end wall or face 110 directly facing the interior of the combustion chamber 42 of the furnace 12.

In accordance with the present invention, around the central cylindrical element 108 in each outlet section 100 there is provided a set of swirl vanes 112 angularly disposed relative to the longitudinal flow axis of the outlet section and extending radially outwardly of the cylindrical element. The swirl vanes 112 are secured to the inside faces of the divider wall 98, the side walls 102, the top wall 104 and the bottom wall 106 to provide a strong structure for imparting swirling action to the separated part streams of primary air and coal flowing through the respective outlet sections 100. As shown in FIG. 4, the swirl vanes 112 in each pair of adjacent vertically stacked outlet sections 100 are installed to provide swirling action in opposite directions as the separate primary air and coal part streams pass into the combustion chamber from a single nozzle outlet structure 90. The left hand upper and lower nozzle sections 100 as viewed in FIG. 4 provide counterclockwise and clockwise swirling action, respectively, and the right hand upper and lower nozzle sections provide clockwise and counterclockwise swirling action, respectively. The intense swirling action generated by the swirl vanes 112 provide for excellent flame stability and flame attachment characteristics and the relatively blunt end face 110 of the cylindrical element 108 promotes a region of reducing atmosphere close to the nozzle outlet structure 90 for reducing the formation of fuel bound $NO_X$ and thermally produced $NO_X$ emissions.

In order to tilt the nozzle outlet structures 90 up and down to raise and lower the fireball in the combustion chamber 42, each burner 60 is equipped with a tilt control rod 114 having a forward end pivotally connected to the nozzle structure by a pin 116 which is offset above the longitudinal axis 86. The tilt control rod 114 is supported in a sleeve 118 mounted on the elbow 70 and has a handle 120 spaced outwardly of the elbow to facilitate longitudinal movement of the control rod to tilt the nozzle outlet structure 90 up or down as desired to balance the burning action and control the fireball position in the combustion chamber 42. Referring to FIG. 2, when the handle 120 is moved to the right or inwardly, the nozzle outlet structure 90 is pivoted downwardly in a clockwise direction so that swirling part streams from the upper and lower outlet sections 100 are pointed downwardly away from a neutral position aligned with the main burner axis 86 as indicated by the arrows A in FIG. 1. When the tilt control handle 120 is pulled toward the left or outwardly as shown in FIG. 2, the nozzle outlet structure 90 is pivoted in a counterclockwise direction upwardly above the burner axis 86 as indicated by the arrows B in FIG. 1. The maximum angle of tilt relative to the burner axis 86 may approximate plus or minus 20° in a typical installation.

When the outlet nozzle structure 90 of a burner 60 is tilted downwardly from the burner axis 86, the primary combustion zone in the combustion chamber 42 is lowered and is then farther away from any overfire air ports (not shown) normally spaced above the level of the burners. This results in a greater retention time for $NO_X$ reduction reactions to occur and thus lowers the amount of $NO_X$ emissions.

Tilting control of the nozzle outlet structures 90 on the burners 60 in a combustion chamber 42 also provides for more precise control of steam temperature, furnace exit gas temperature, carbon burn out and coal particle devolitization. By providing individual tilt control for each burner 60 in a combustion chamber 42, a significant number of variable settings can be tested and evaluated on line for optimizing unit operation. These tilt angle changes and adjustments can be accomplished on line without interrupting boiler operation. Moreover, individual burner tilt adjustments can be made to better distribute the coal particles and/or other fuel in the combustion chamber 42. Tilting of the nozzle outlet structures 90 toward and away from the opposite water walls 46 and 48 and the remote banks of tubes 51 and 53 is extremely effective to provide precise control of steam temperature, reduced $NO_X$ emissions and a highly efficient combustion process in which carbon burnout is increased.

In order to provide better fuel distribution flowing into the tiltable nozzle outlet structure 90 of a burner 60, a bank of adjustable turning vanes 122 is mounted in each elbow 70 supported for movement toward and away from the nozzle outlet structure at different positions along the burner axis 86. Each bank of turning vanes 122 is positioned by a control rod 124 slidable in a sleeve 126 on an elbow 70 and provided with a handle 128 on the outer end to facilitate adjustment for the best distribution of coal particles flowing from the elbow toward the associated tiltable nozzle outlet structure 90.

Further and even more precise adjustment and control of the burning process, flame stabilization and flame attachment is provided by a plurality of secondary air control vanes 130 mounted in the burner opening 44 outside of the tiltable nozzle outlet structure 90. The vanes 130 are mounted on axles 132 which are generally parallel of the transverse tilt axis 92 and each vane can be pivoted up or down relative to the burner axis 86 by rotation of the supporting axle. Control of the secondary combustion air around the part streams of primary combustion air and fuel provides means for shaping and tuning the flame pattern extending out from the outlet sections 100 of the burners 60.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. Apparatus for burning fuel, comprising:

conduit means having an outlet end for supplying a fuel/air mixture to a fuel burning zone;

nozzle means adjacent said outlet end mounted for pivotal movement relative to a pivot axis extending transversely across said conduit means, said pivot axis of said nozzle means extending in a generally horizontal direction transversely across a longitudinally extending central axis of said conduit means;

said nozzle means having an inlet end portion surrounding said outlet end of said conduit means and having a plurality of separate outlet sections joining said inlet end portion; and swirl vane means in each of said outlet sections for causing the fuel/air mixture in adjacent outlet sections to swirl about respective central swirl axes thereof in opposite directions, said central swirl axes of said outlet sections being spaced above and below said central axis of said conduit means.

2. The apparatus of claim 1, wherein:

said central axis of said conduit means and said central swirl axes of said outlet sections are substantially aligned in a common vertical plane.

3. The apparatus of claim 1, including:

means for pivotally moving said nozzle means about said pivot axis to tilt said central swirl axes of said outlet sections up and down.

4. The apparatus of claim 3 wherein:

said central swirl axes of said outlet sections are substantially aligned in a common vertical plane with a central longitudinal axis of said conduit means and are movable to tilt upwardly and downwardly with respect thereto.

5. The apparatus of claim 4, wherein:

said central longitudinal axis of said conduit means slopes downwardly from an inlet thereof toward said outlet end.

6. Fuel burning apparatus, comprising:

a conduit for directing a flow of primary air and fuel along a central axis of said conduit toward an outlet end into a combustion zone;

a nozzle structure mounted for pivotal movement about a lateral axis adjacent said outlet end, said nozzle structure including a plurality of adjacent, separate outlet sections, said separate outlet sections being stacked vertically with one above another and each separate outlet section having swirl vanes therein for causing a separate stream of said primary air and fuel to swirl about a central axis of said outlet section; and control means for tilting said nozzle structure about said lateral axis to tilt said separate streams up and down relative to said central axis of said conduit.

7. The fuel burning apparatus of claim 6, wherein:

said swirl vanes in said separate outlet sections are arranged to cause said separate streams to swirl in opposite directions.

8. The fuel burning apparatus of claim 6, wherein:

said nozzle structure includes an inlet end receiving said flow of primary and fuel from said outlet end of said conduit.

9. The fuel burning apparatus of claim 8, wherein:

said inlet end of said nozzle structure includes at least one inlet outside of said conduit for receiving secondary air for discharge through an outlet section.

10. The fuel burning apparatus of claim 9, wherein:

said inlet end of said nozzle structure includes a plurality of said inlets above and below said outlet end of said conduit.

11. The fuel burning apparatus of claim 10, wherein:

said outlet end of said conduit has a divergent section downstream of said inlets of said inlet end of said nozzle structure.

12. A furnace comprising:

a combustion chamber having a wall and one or more fuel burners mounted on said wall in a burner opening therein;

a supply conduit for supplying a flow of primary air and fuel to said burner;

a windbox for supplying secondary combustion air to said combustion chamber through said burner opening around said burner;

said burner including a central fuel/air duct connected to said supply conduit and having an outlet end centered in said burner opening for supplying fuel and primary combustion air to said combustion chamber, said burner including a nozzle structure in said burner opening mounted for movement about a pivot axis extending across said opening, said nozzle structure including a plurality of outlet sections, each having swirl vanes therein for causing a stream of said primary air and fuel to swirl around a central axis of said outlet section flowing into said combustion chamber, said swirl vanes in adjacent outlet sections arranged to cause one of said streams discharged therethrough to be spaced above the other and to swirl in an opposite directions; and control means for tilting said nozzle structure to direct said stream up and down relative to a central axis of said fuel/air duct.

13. The furnace of claim 12, wherein:

said burner opening is larger than and surrounds said nozzle structure and forms a secondary air outlet for secondary air to flow into said combustion chamber from said windbox.

14. The furnace of claim 13, including:

one or more vanes in said burner opening adjustable to direct secondary flow toward or away from said stream flowing into said combustion chamber from said nozzle structure outlet sections.

15. The furnace of claim 14, including:

a plurality of said vanes spaced apart on opposite sides of said burner opening and said nozzle structure.

16. Apparatus for burning fuel in a combustion chamber having a wall, comprising:

conduit means having an outlet for directing a main stream of primary combustion air and fuel along a longitudinal axis into said combustion chamber from said wall;

nozzle means at said outlet having a plurality of outlet sections for dividing said main stream into separate part streams spaced above and below one another, each part stream having a center axis in coaxial alignment with a center axis of an outlet section;

swirl vane means in each of said outlet sections for causing said part streams to swirl about said central axes of said respective outlet sections; and means for tilting said nozzle means to change the angular relationship between said central axes and said longitudinal axis for precision control of $NO_X$ emissions from said combustion chamber.

17. The apparatus of claim 16, including:

water/steam tubes for steam generation from heat developed in said combustion chamber; and wherein:

said tilting means is arranged to move said axes closer to and farther from said water/steam tubes for controlling the temperature of steam being generated in said water/steam tubes.

18. The apparatus of claim 16, wherein:

said tilting means is arranged to raise and lower the center axis of each part stream in said combustion chamber for controlling the burnout of carbon in said fuel.

19. The apparatus of claim 16, wherein:

said conduit means is mounted adjacent a central portion of an opening formed in the wall of the combustion chamber; and including:

means for supplying secondary combustion air into said combustion chamber through said wall opening around said nozzle means.

20. The apparatus of claim 19, including:

secondary vane means for directing said secondary combustion air toward and away from said axes of said part streams for optimizing combustion efficiency in said combustion chamber.

21. The apparatus of claim 20, wherein:

said secondary vane means are angularly adjustable relative to said longitudinal axis for optimizing combustion efficiency and minimizing $NO_X$ emissions.

* * * * *